US010047952B2

(12) United States Patent
Kim et al.

(10) Patent No.: US 10,047,952 B2
(45) Date of Patent: Aug. 14, 2018

(54) DUAL VENTURI FOR COMBUSTION DEVICE

(71) Applicant: KYUNGDONG NAVIEN CO., LTD, Pyeongtaek-si, Gyeonggi-do (KR)

(72) Inventors: Kyeong Joo Kim, Bucheon-si (KR); Sung Ki Kim, Yongin-si (KR)

(73) Assignee: KYUNGDONG NAVIEN CO., LTD., Gyeonggi-do (KR)

( * ) Notice: Subject to any disclaimer, the term of this patent is extended or adjusted under 35 U.S.C. 154(b) by 343 days.

(21) Appl. No.: 14/774,423

(22) PCT Filed: Apr. 15, 2014

(86) PCT No.: PCT/KR2014/003222
§ 371 (c)(1),
(2) Date: Sep. 10, 2015

(87) PCT Pub. No.: WO2014/171690
PCT Pub. Date: Oct. 23, 2014

(65) Prior Publication Data

US 2016/0061445 A1 Mar. 3, 2016

(30) Foreign Application Priority Data

Apr. 16, 2013 (KR) ..... 10-2013-0041874

(51) Int. Cl.
*F23D 14/60* (2006.01)
*F23N 1/02* (2006.01)
(Continued)

(52) U.S. Cl.
CPC ..... *F23D 14/60* (2013.01); *F23D 14/04* (2013.01); *F23N 1/02* (2013.01); *F23N 5/00* (2013.01); *F24H 9/2035* (2013.01)

(58) Field of Classification Search
CPC ..... F23D 14/60
(Continued)

(56) References Cited

U.S. PATENT DOCUMENTS 2,380,374 A * 7/1945 Anderson ..... F02M 31/083 123/552
2,905,543 A 9/1959 Schreter et al.
(Continued)

FOREIGN PATENT DOCUMENTS

EP 2949994 A1 12/2015
KR 10-0805630 B1 2/2008
(Continued)

*Primary Examiner* — Avinash Savani
(74) *Attorney, Agent, or Firm* — Novick, Kim & Lee, PLLC; Jae Youn Kim

(57) ABSTRACT

A dual venturi for a combustion device that can control the quantities of gas and air supplied to the burner of a water heater and in which a motor is combined with a damper so as to simultaneously open and close the inlets for secondary air and gas and efficiently control the quantity of heat, in order to increase the turn-down ratio. The dual venturi includes: a housing having a discharge part coupled to a turbo fan; an air supply unit divided into first and second air supply units; a gas supply unit divided into first and second gas supply units communicating with the first and second air supply units; and an opening and closing unit that blocks the flow of secondary air and secondary gas when needing a low quantity of heat, and opens both the second air supply unit and the second opening when needing a high quantity of heat.

7 Claims, 8 Drawing Sheets

(51) Int. Cl.

| | |
|---|---|
| ***F24H 9/20*** | (2006.01) |
| ***F23D 14/04*** | (2006.01) |
| ***F23N 5/00*** | (2006.01) |

(58) Field of Classification Search
USPC ..... 431/354; 236/75
See application file for complete search history.

(56) References Cited

U.S. PATENT DOCUMENTS

| | | | | | |
|---|---|---|---|---|---|
| 3,009,794 | A | * | 11/1961 | Barfod | F02M 21/047 261/69.1 |
| 3,090,423 | A | * | 5/1963 | Atterbury, Jr. | F23N 5/04 236/10 |
| RE25,492 | E | * | 12/1963 | Dolza | F02D 9/00 123/446 |
| 5,067,523 | A | | 11/1991 | Fraioli | |
| 2011/0139045 | A1 | | 6/2011 | Zatti et al. | |
| 2012/0058439 | A1 | * | 3/2012 | Munsterhuis | F23N 5/003 431/12 |

FOREIGN PATENT DOCUMENTS

| | | | |
|---|---|---|---|
| KR | 10-2010-0020084 | A | 2/2010 |
| WO | 2012/007823 | A1 | 1/2012 |

* cited by examiner

"PRIOR ART"

DUAL VENTURI FOR COMBUSTION DEVICE

TECHNICAL FIELD

The present invention generally relates to a dual venturi for a combustion device provided with inlets for primary air and primary gas and inlets for secondary air and secondary gas to increase a turn-down ratio which controls the quantities of gas and air supplied to a burner of a water heater by opening only the inlets for primary air and gas or by opening both the inlets for primary air and gas and the inlets for secondary air and gas. In particular, the present invention relates to a dual venturi for a combustion device in which a motor is combined with a damper so that the damper is rotated by the operation of the motor and simultaneously opens and closes the inlets for secondary air and gas, thereby efficiently controlling the quantity of heat produced.

BACKGROUND ART

In general, combustion devices, such as boilers and water heaters, used for heating or producing hot water are classified according to fuel into oil boilers, gas boilers, electric boilers, water heaters, etc. Various combustion devices are developed and appropriately used according to purposes thereof.

Of conventional combustion devices, a gas boiler and a water heater generally use a Bunsen burner or a premixed burner for burning gas fuel, and among them, the premixed burner realizes combustion by mixing gas and air at an optimum mixing ratio for combustion and supplying the mixture (air+gas) to a burner port.

Further, the performance of the combustion device is typically measured by the turn-down ratio (TDR). Here, the turn-down ratio means 'the ratio of the maximum gas consumption to the minimum gas consumption' in a gas combustion device in which the quantity of gas is variably controlled. For example, when the maximum gas consumption is set to 24,000 kcal/h and the minimum gas consumption is set to 8,000 kcal/h, the turn-down ratio (TDR) is 3:1. Here, the turn-down ratio (TDR) is typically limited by the capability of the combustion device to maintain a stable flame under the condition of minimum gas consumption.

In the case of a gas boiler and a water heater, the convenience thereof when using the device for heating or for producing hot water may be increased in proportion to the higher value of the turn-down ratio (TDR). In other words, when the turn-down ratio (TDR) is low (the case in which the minimum gas consumption is high) and the burner is operated in an area with a low load of heating or hot water, the combustion device may turn on and off frequently so that the deviation when controlling the temperature is increased and the durability of the device is reduced. To solve the above problems, various technologies have been developed to increase the turn-down ratios (TDR) of burners of combustion devices.

Gas supply valves used in the above-mentioned modulating burners are classified into an electric modulating gas valve that is largely controlled by an electric current and a pneumatic modulating gas valve that is controlled by an air pressure difference generated when air is supplied to a burner.

Here, the pneumatic modulating gas valve controls the quantity of gas supplied to the burner by using an air pressure difference generated when air required for combustion is supplied to the burner using a blower. Here, the air and gas required for combustion are mixed in a gas-air mixer and then supplied to the burner as mixed gas (a mixture of air and gas).

In the gas-air mixer of the gas burner using the pneumatic modulating gas valve, the turn-down ratio (TDR) is generally limited by the relationship between the gas consumption (Q) and the pressure difference (ΔP). In a fluid, the relationship between the flow rate and the pressure difference (ΔP) is expressed by the following equation.

$$Q=k\sqrt{\Delta P}$$

That is, the pressure difference of a fluid must be increased four times in order to double flow rate thereof.

Accordingly, to set the turn-down ratio (TDR) to 3:1 for instance, the ratio of the pressure difference must be set to 9:1. Further, to set the turn-down ratio (TDR) to 10:1 for instance, the ratio of the pressure difference must be set to 100:1. However, it is impossible to infinitely increase the supplied pressure of gas.

To overcome the problems experienced by the fact that it is impossible to increase the supplied pressure of gas infinitely, a method of increasing the turn-down ratio (TDR) by dividing each path for supplying air and gas into two or more parts as shown in FIG. 1 and opening and closing each path for supplying gas to the burner was proposed.

DISCLOSURE

Technical Problem

Korean Patent Application No. 2012-15100 was previously filed by the applicant of this invention with reference to FIG. 1, Comprising: a housing 10*a* provided with a primary gas inlet 14*a* and a secondary gas inlet 15*a* formed at one side of an upper portion thereof, with the interior of the housing 10*a* being divided by a partition 13*a* into a first channel 11*a* and a second channel 12*a*; and an opening and closing unit 100*a* provided inside the housing 10*a* and communicating at an upper end thereof with the second gas inlet 15*a* so that gas can flow into the unit 100*a*, in which a damper having blades at both ends is rotated by the operation of a motor 180*a* provided outside the housing 10*a*, thereby controlling the flow of air and gas by opening and closing the second channel 12*a*.

However, the above-mentioned dual venturi for the combustion device is problematic in that it needs a large number of components, thus reducing productivity, and, particularly, in that the airtightness of the opening and closing unit that blocks or allows the flow of secondary gas and air is insufficient.

Accordingly, the present invention has been made keeping in mind the above problems occurring in the related art, and the present invention aims to provide a dual venturi for a combustion device having a simplified construction capable of realizing miniaturized combustion device, improved operational reliability, easy production, and reduced cost.

Technical Solution

In order to achieve the above objective, according to one aspect of the present invention, there is provided a dual venturi for a combustion device, the dual venturi including: a housing having a discharge part coupled to a turbo fan at one side thereof, and having in an interior thereof a predetermined space for allowing gas and air to flow; an air supply unit provided in the inner side of the housing and divided by a first partition 130 into a first air supply unit and a second air supply unit; a gas supply unit provided on one surface of the housing and divided by a second partition into a first gas supply unit having a first opening so as to communicate with the first air supply unit and a second gas supply unit having a second opening so as to communicate with the second air supply unit; and an opening and closing unit configured such that when the combustion device needs a low quantity of heat, the opening and closing unit blocks both the second air supply unit and the second opening, thereby blocking the flow of secondary air and secondary gas, and when a high quantity of heat is needed, the opening and closing unit opens both the second air supply unit and the second opening.

In one embodiment, the opening and closing unit may include: a motor provided outside the housing; a damper combined with the motor and provided with at least two concave guides and convex guides on an inner surface thereof; a movable body having concave guides and convex guides that are correspondingly engaged respectively with the concave guides and the convex guides of the damper; and a valve body combined to a center of the movable body, and opening and closing the second opening in response to the movement of the movable body.

In one embodiment, the movable body may further include an inner housing at an outer portion thereof, the inner housing guiding the movement of the movable body, and having a gas discharge hole at the discharge part.

In one embodiment, the movable body may further include a spring, a first end of the spring being in contact with the outer surface of the movable body and another end of the spring being in contact with the inner surface of the inner housing so that the spring elastically supports the movable body.

In one embodiment, the valve body may be made of rubber or silicone material so as to increase the contact force with the movable body.

In one embodiment, the motor may be a synchronous motor.

In one embodiment, the motor may further include a limit switch that rotates the damper at 90 degree angles.

Advantageous Effects

The dual venturi for the combustion device according to the present invention is primarily advantageous in that the dual venturi can control the high quantity of heat and the low quantity of heat in the combustion device, thereby reducing the cost of fuel.

Secondarily, in the dual venturi of the present invention, the interior of the housing is divided by the partition into the first channel and the second channel, and is configured such that only the primary air and primary gas flow in the first channel and only the secondary air and secondary gas flow in the second channel, so that the dual venturi can easily control the turn-down ratio by controlling the flow of air and gas in the second channel.

Thirdly, the dual venturi of the present invention is configured such that the secondary gas outlet and the second channel are simultaneously opened and closed by the rotation of the damper, thereby the dual venturi is advantageous in that a structure may be significantly simplified, so that the parts thereof are simplified, the period of time for designing and manufacturing the dual venturi is reduced, and repair of the dual venturi when it is malfunctioning is simplified.

DESCRIPTION OF DRAWINGS

FIGS. 5 to 8 are views illustrating the operating state of the dual venturi for the combustion device according to the present invention, in which FIGS. 5 and 6 are views illustrating the operation when the flow of secondary air and gas is blocked, and FIGS. and 8 are views illustrating the operation when the flow of secondary air and gas is allowed.

MODE FOR INVENTION

Figure 1:
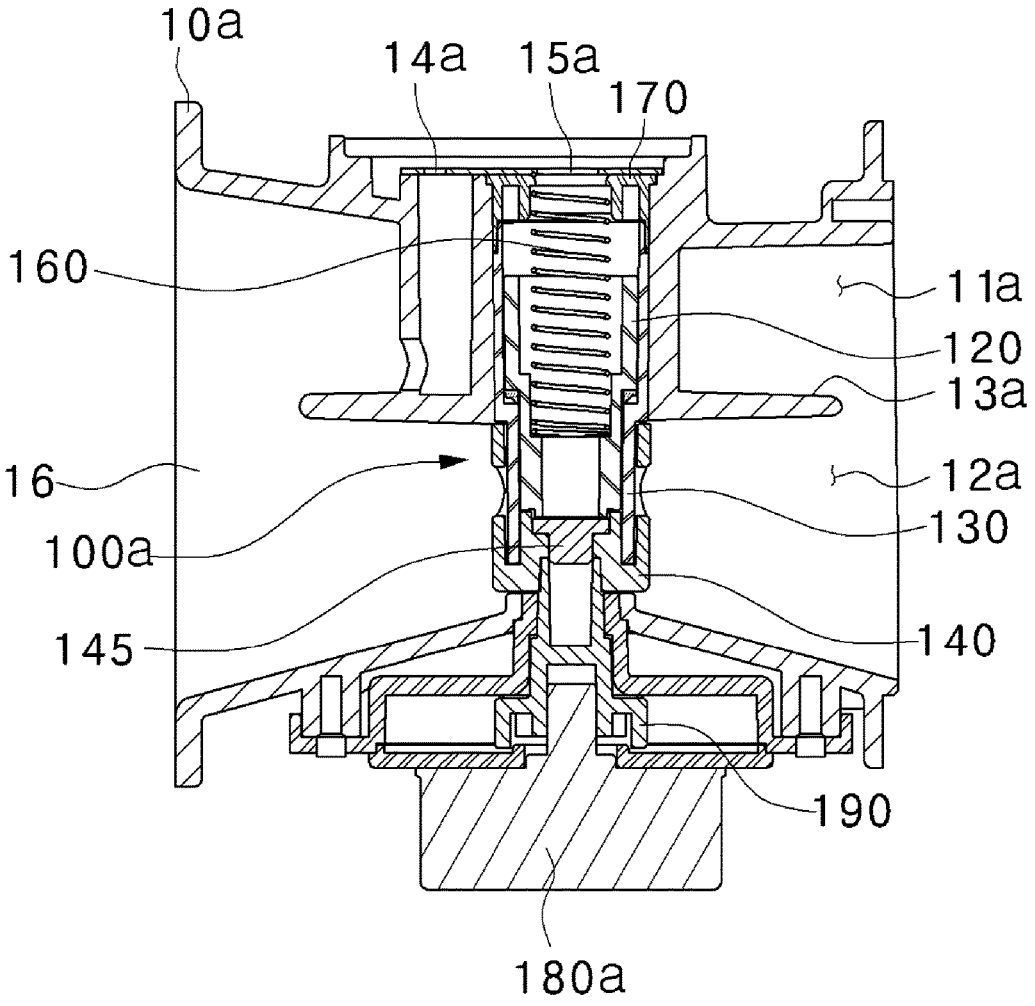
FIG. 1 is a cross-sectional view showing a related art.

Reference will now be made in greater detail to an exemplary embodiment of the present invention, with reference to the accompanying drawings. However, it should be understood that the embodiment of the present invention may be changed to a variety of embodiments and the scope of the present invention is not limited to the embodiment described hereinbelow. The embodiment of the present invention described hereinbelow is provided for allowing those skilled in the art to more clearly comprehend the present invention. Therefore, it should be understood that the shape, etc. of the elements shown in the drawings may be exaggerated to provide an easily understood description of the structure of the present invention. It should be noted that the same reference numerals are used throughout the drawings to refer to the same or like elements. Further, the detailed description on conventional functions and elements considered to make the gist of the present invention unclear will be omitted.

Hereinbelow, a dual venturi for a combustion device according to the present invention will be described in detail by describing a preferred embodiment of the present invention with reference to the accompanying drawings.

Figure 2:
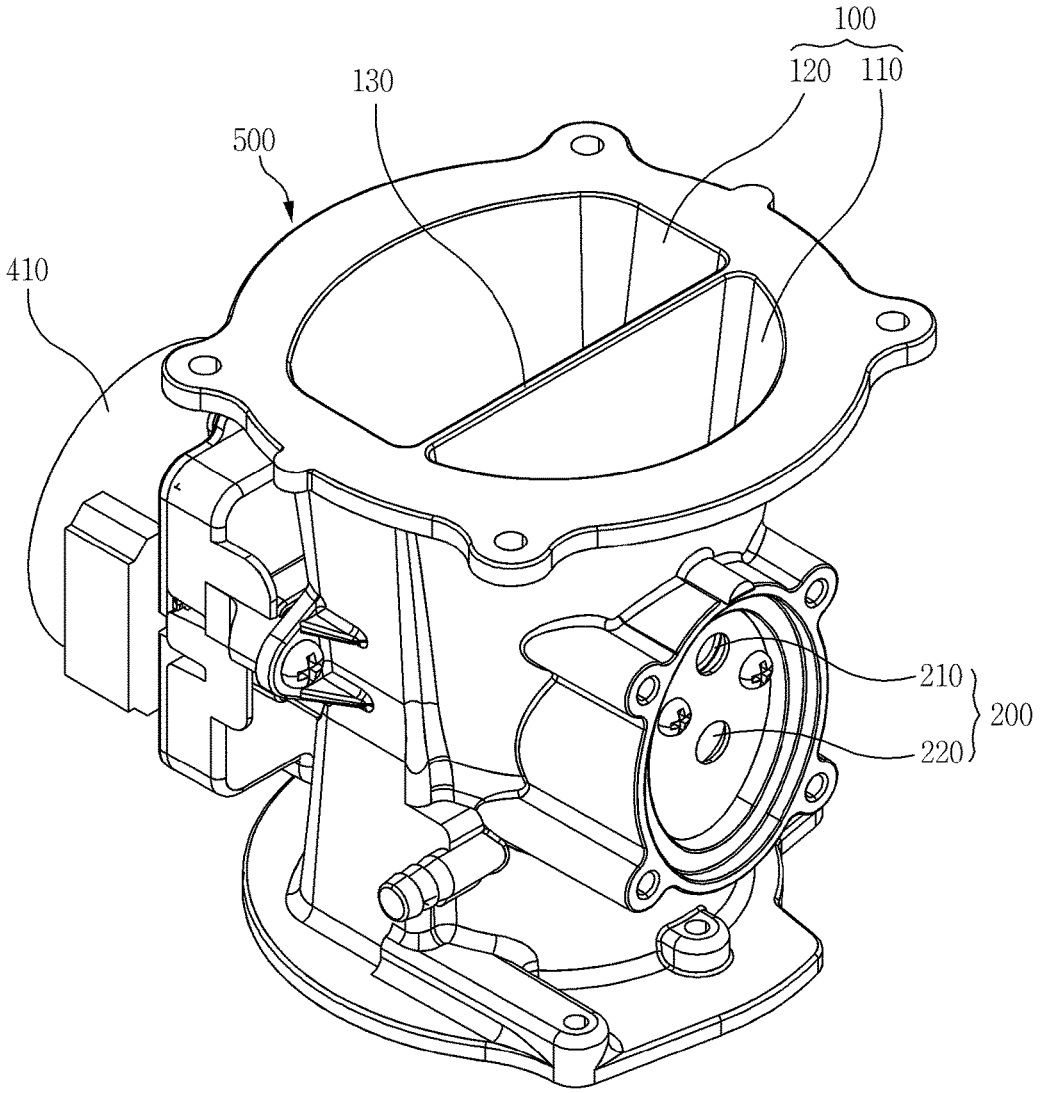
FIG. 2 is a perspective view illustrating a dual venturi for a combustion device according to the present invention.
Figure 3:
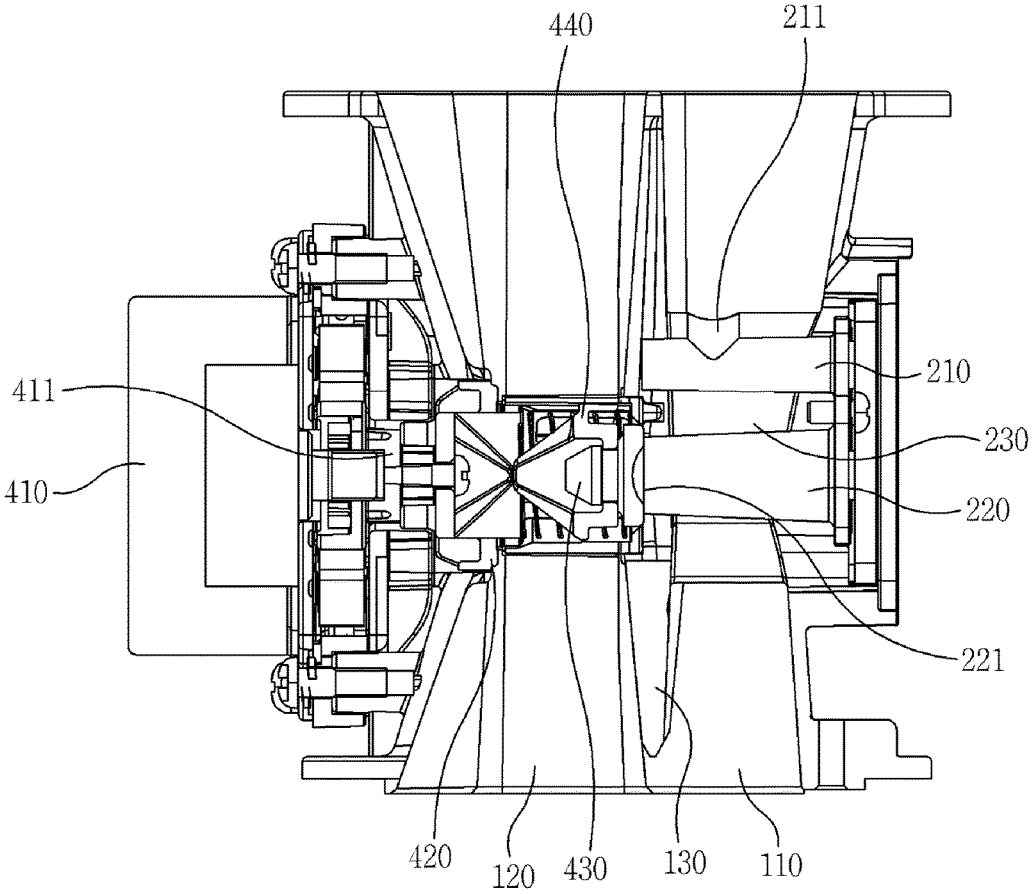
FIG. 3 is a cross-sectional view taken along line A-A of FIG. 2.

FIG. 2 is a perspective view illustrating the dual venturi for a combustion device according to the present invention. FIG. 3 is a cross-sectional view taken along line A-A of FIG. 2, and FIG. 4 is an exploded perspective view of an opening and closing unit shown in FIG. 3.

Figure 4:
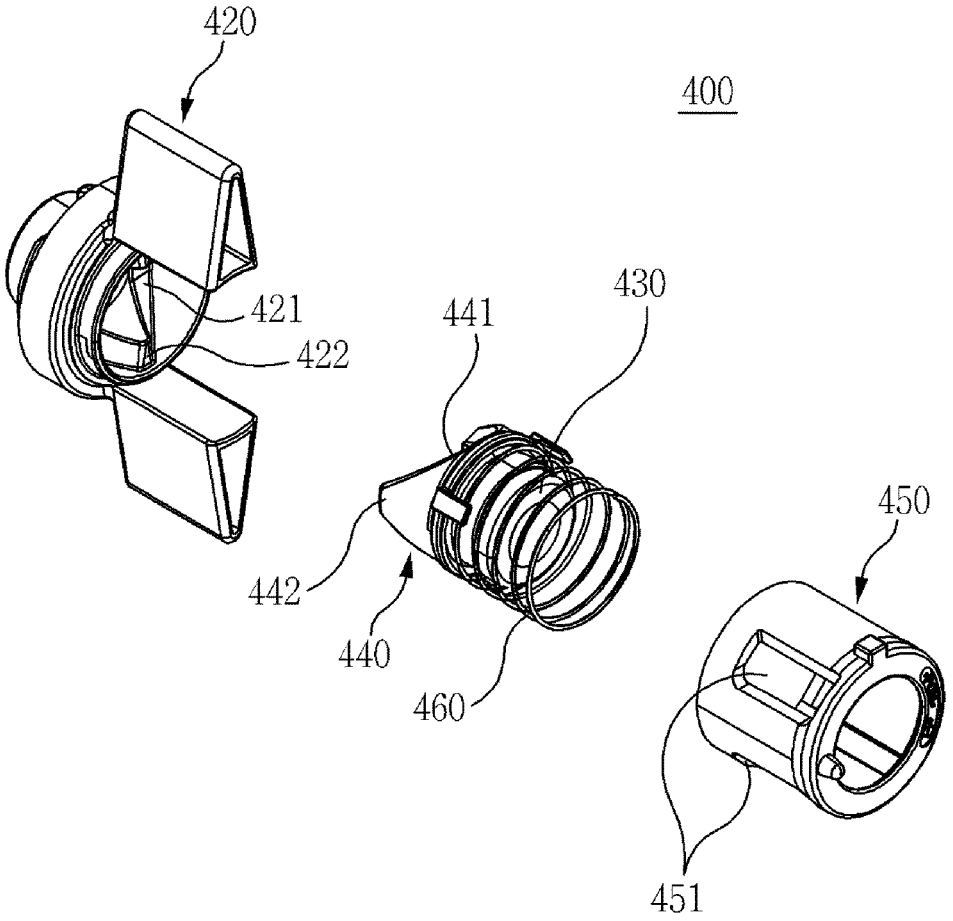
FIG. 4 is an exploded perspective view of an opening and closing unit shown in FIG. 3.

As shown in FIGS. 2 to 4, the dual venturi for the combustion device according to the present invention includes a housing 500 that is provided with a discharge part 300 in a lower part thereof so that mixed gas prepared by mixing air and gas can be introduced into a turbo fan via the discharge part 300 prior to being supplied to a burner.

Meanwhile, an air supply unit 100 and a gas supply unit 200 are provided in the housing 500. Here, the air supply unit 100 is divided by a first partition 130 into a primary air supply unit 110 and a secondary air supply unit 120.

Further, the gas supply unit 200 is provided on one side of the housing 500 and is divided by a second partition 230 into a primary gas supply unit 210 and a secondary gas supply unit 220. Here, the primary gas supply unit 210 is provided with a first opening 211 so as to communicate with the primary air supply unit 110, and the secondary gas supply unit 220 is provided with a second opening 221 so as to communicate with the secondary air supply unit 120.

Further, an opening and closing unit 400 that can open and close the secondary air supply unit 120 and the secondary gas supply unit 220 is provided at the middle of the housing 500.

If described in detail, the opening and closing unit 400 includes: a motor 410 provided outside the housing 500; a damper 420 provided with at least two concave guides 421 and convex guides 422 on an inner surface thereof, and combined with the motor 410; a movable body 440 having concave guides 441 and convex guides 442 that are correspondingly engaged respectively with the concave guides 421 and the convex guides 422 of the damper; and a valve body 430 combined with the center of the movable body 440, and opening and closing the second opening 221 in response to movement of the movable body 440.

The movable body 440 may further include: a spring 460, a first end of the spring 460 being in contact with the outer surface of the movable body 440 and another end of the spring 460 being in contact with the inner surface of an inner housing 450 so that the spring elastically supports the movable body 440.

Here, the inner housing 450 is provided outside the movable body 440. The inner housing 450 guides the movement of the movable body 440, and has a gas discharge hole 451 directed toward the discharge part 300. The inner housing 450 is fitted over the spring 460 so that the spring 460 can efficiently perform compression and expansion without being diverted from a designated path under the guide of the inner housing 450.

Further, the motor 410 is preferable to be a synchronous motor, so as to reduce the production cost of the dual venturi by using a generally used low-cost synchronous motor.

Further, a limit switch 411 may be combined with the motor 410, to rotate the damper 420 at 90 degree angles.

Further, the valve body 430 may be made of rubber or silicone material so as to increase the contact force with the second opening 221.

Hereinbelow, the operation of the dual venturi for the combustion device according to the present invention having the above-mentioned construction will be described.

Figure 5:
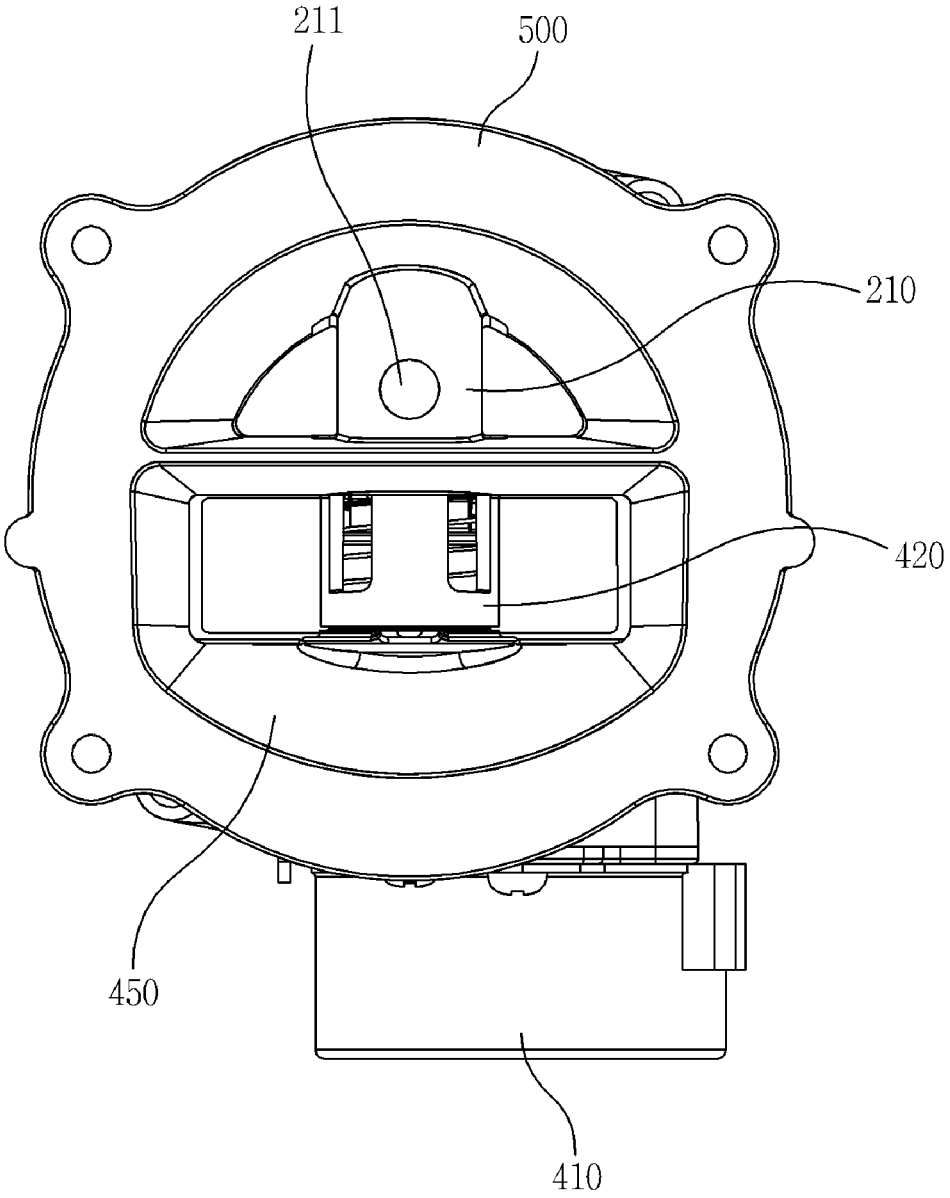
Figure 6:
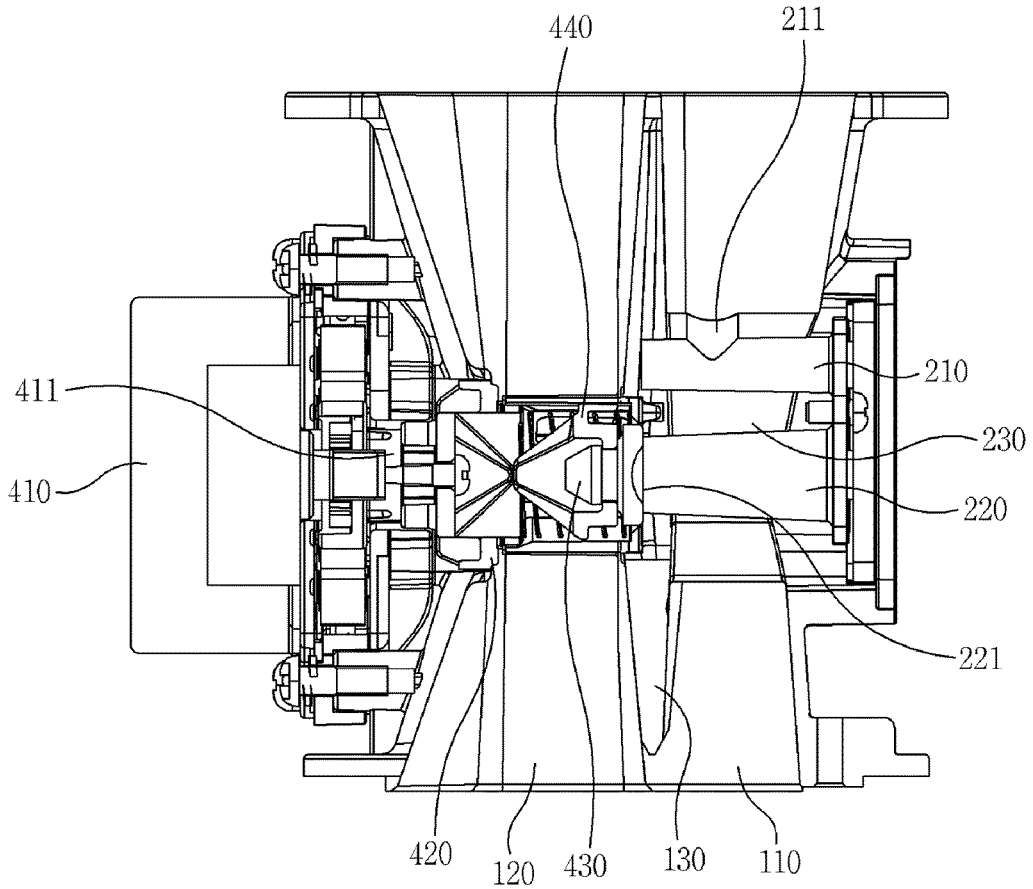
Figure 7:
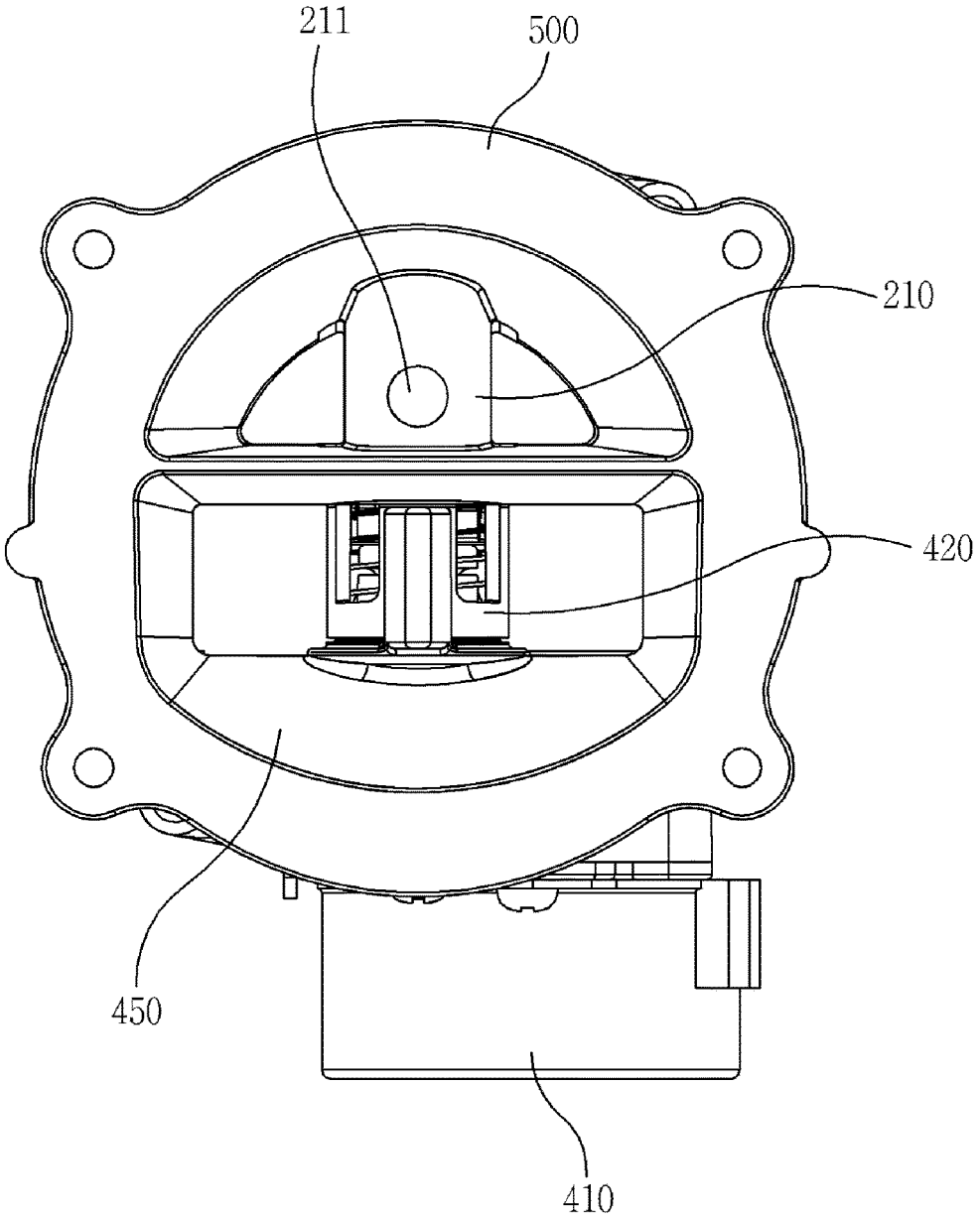
Figure 8:
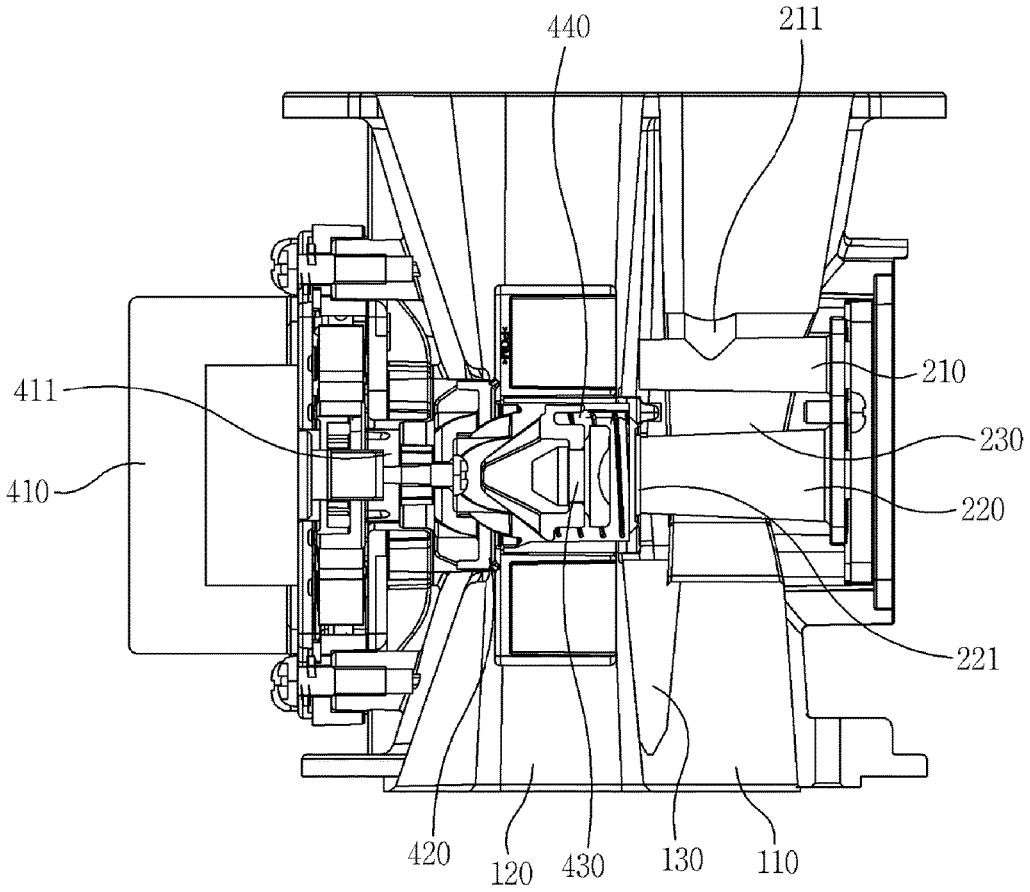

FIGS. 5 to 8 are views illustrating the operation of the dual venturi for the combustion device according to the present invention, in which FIGS. 5 and 6 are views illustrating the operation when the flow of secondary air and gas is blocked, and FIGS. 7 and 8 are views illustrating the operation when the flow of secondary air and gas is allowed.

As shown in FIGS. 5 and 6, in an initial stage of the operation of a water heater, the tip of the convex guide 422 of the damper 420 comes into contact with the tip of the convex guide 442 of the movable body 440 so that the movable body 440 moves upward. Thus, the valve body 430 of the opening and closing unit 400 closes the second opening 221, thereby blocking the flow of secondary gas and, at the same time, blades at both ends of the damper 420 close the secondary air supply unit 120, thereby blocking the flow of secondary air. Therefore, with the air flow blocked only the primary air and primary gas that are introduced via the primary air supply unit 110 and the primary gas supply unit 210 are mixed together to be supplied to the turbo fan (the mixed gas flows upward in the embodiment). Here, the mixed gas flowing into the turbo fan via the primary air supply unit 110 and the primary gas supply unit 210 is used when the water heater needs a low quantity of heat.

However, when the water heater needs a high quantity of heat, both the secondary air supply unit 120 and the secondary gas supply unit 220 are opened. At this time, secondary air is introduced via the secondary air supply unit 120 and secondary gas is introduced via the secondary gas supply unit 220 by the operation of the opening and closing unit 400.

In further describing the operating state in more detail, when the motor 410 is powered on, the motor 410 is operated to rotate the damper 420 at a 90 degree angle, so that the convex guide 422 is engaged with the concave guide 441 of the movable body 440 by being inserted thereinto via the rotation of the damper 420, and the movable body 440 moves downward, as shown in FIGS. 7 and 8. Thus, the valve body 430 that was blocking the second opening 221 opens the second opening 221, so that secondary gas flowing into the secondary gas supply unit 220 is mixed with air that is introduced into the secondary air supply unit 120 via the gas discharge hole 451 of the inner housing 450, and then supplied into the turbo fan.

In other words, when the damper 420 rotates, the spring 460 expands to produce pressure. Due to the pressure of the spring 460, the movable body 440 moves downward, thereby opening the second opening 221. Here, when the valve body 430 moves downward, the movable body 440 that is combined with the center of the valve body 430 also moves downward so that secondary gas is introduced via the secondary gas supply unit 220 and can be mixed with secondary air.

To operate the combustion device with a low quantity of heat again, the motor 410 is rotated again at a 90 degree angle so that the tip of the convex guide 422 of the damper 420 comes into contact with the tip of the convex guide 442 of the movable body 440 and the movable body 440 moves upward, as shown in FIGS. 5 and 6. Thus, the valve body 430 closes the second opening 221 and blocks the flow of secondary gas and, at the same time, the blades at both ends of the damper 420 close the secondary air supply unit 120, thereby blocking the flow of secondary air.

As described above, the above-mentioned dual venturi of the present invention can selectively output low quantity of heat or high quantity of heat as desired by a combustion device so that the low quantity of heat or the high quantity of heat can be controlled as desired by a user, and thereby reducing the cost of fuel.

Although the preferred embodiment of the dual venturi for the combustion device according to the present invention have been disclosed for illustrative purposes, those skilled in the art will appreciate that various modifications, additions and substitutions are possible, without departing from the scope of the invention.

The invention claimed is:

1. A dual venturi for a combustion device, the dual venturi comprising:

a housing having at one side thereof a discharge part coupled to a turbo fan, and in an interior thereof a predetermined space for allowing gas and air to flow;

an air supply unit defined in the interior of the housing and divided by a first partition into a first air supply unit and a second air supply unit;

a gas supply unit provided on another side of the housing and divided by a second partition into a first gas supply unit having a first opening so as to communicate with the first air supply unit and a second gas supply unit having a second opening so as to communicate with the second air supply unit; and an opening and closing unit including:

a motor provided outside the housing;

a damper connected with the motor, the damper having at least two concave guides and at least two convex guides on an inner surface thereof;

a movable body having at least two concave guides and at least two convex guides that are correspondingly engaged respectively with the at least two concave guides and the at least two convex guides of the damper; and a valve body connected with a center of the movable body, and opening and closing the second opening in response to movement of the movable body, wherein the valve body is configured to close the second opening when the damper closes the second air supply unit, and to open the second opening when the damper opens the second air supply unit.

2. The dual venturi for the combustion device according to claim 1, wherein the movable body further includes an inner housing at a position outside the movable body, the inner housing guiding the movement of the movable body and having a gas discharge hole directed toward the discharge part.

3. The dual venturi for the combustion device according to claim 2, wherein the movable body further includes a spring, a first end of the spring being in contact with an outer surface of the movable body and another end of the spring being in contact with an inner surface of the inner housing so that the spring elastically supports the movable body.

4. The dual venturi for the combustion device according to claim 1, wherein the valve body is made of a rubber or a silicone material so as to increase a contact force with the movable body.

5. The dual venturi for the combustion device according to claim 1, wherein the motor is a synchronous motor.

6. The dual venturi for the combustion device according to claim 1, wherein the motor further includes a limit switch to rotate the damper at 90 degree angles.

7. The dual venturi for the combustion device according to claim 5, wherein the motor further includes a limit switch to rotate the damper at 90 degree angles.

* * * * *